US007823742B2

(12) United States Patent
Valentine et al.

(10) Patent No.: US 7,823,742 B2
(45) Date of Patent: Nov. 2, 2010

(54) SEAL

(75) Inventors: Scott Valentine, Glossop (GB); Jonathan Hart, Stockport (GB); Mark Chadwick, Stockport (GB)

(73) Assignee: Future Technology (R&D) Limited, Banbury, Oxford (GB)

( * ) Notice: Subject to any disclaimer, the term of this patent is extended or adjusted under 35 U.S.C. 154(b) by 421 days.

(21) Appl. No.: 11/702,270

(22) Filed: Feb. 5, 2007

(65) Prior Publication Data

US 2007/0205133 A1 Sep. 6, 2007

Related U.S. Application Data

(63) Continuation of application No. PCT/GB2005/003058, filed on Aug. 4, 2005.

(30) Foreign Application Priority Data

Aug. 5, 2004 (GB) ..... 0417382.9

(51) Int. Cl.
*B65D 1/24* (2006.01)

(52) U.S. Cl. ..... 220/507; 206/469; 206/528; 206/531; 215/232; 220/359.1; 220/523; 220/524

(58) Field of Classification Search ..... 206/528, 206/534.1, 538, 469, 531, 532; 220/507, 220/359.1, 523, 524; 215/232
See application file for complete search history.

(56) References Cited

U.S. PATENT DOCUMENTS

| | | | | |
|---|---|---|---|---|
| 3,311,229 | A | | 3/1967 | Troll et al. |
| 3,414,414 | A | | 12/1968 | Christine et al. |
| 3,738,480 | A | | 6/1973 | Chesley |
| 3,880,285 | A | | 4/1975 | March |
| 3,921,805 | A | | 11/1975 | Compere |
| 3,924,748 | A | * | 12/1975 | Braverman ..... 206/534.1 |
| 4,294,361 | A | | 10/1981 | Margulies et al. |
| 4,316,541 | A | | 2/1982 | Braverman et al. |
| 4,693,371 | A | | 9/1987 | Malpass |
| 5,203,455 | A | | 4/1993 | Hewelt et al. |
| 5,339,960 | A | | 8/1994 | Price |
| 5,360,116 | A | | 11/1994 | Schmiletzky |

(Continued)

FOREIGN PATENT DOCUMENTS

DE 43 24 771 A1 2/1993

(Continued)

*Primary Examiner*—Anthony Stashick
*Assistant Examiner*—Elizabeth Volz
(74) *Attorney, Agent, or Firm*—Kilyk & Bowersox, P.L.L.C.

(57) ABSTRACT

A seal for a pill dispenser having a body including a plurality of recesses formed in a surface of the body, each recess having an open mouth bounded by a surrounding portion of the body surface, the seal comprising a cover film defining a plurality of apertures to provide access to the open mouths of the recesses, each aperture being cut in the cover film so as to be smaller than the open mouth of the corresponding recess and being closed by a liner cut from a liner film, the liner being larger than the aperture and being adhered to the cover film around the entire periphery of the aperture, the seal in use being adhered to the body surface of the pill dispenser so that the liners are located between the cover film and the open mouths of the corresponding recesses and each liner is removable.

7 Claims, 6 Drawing Sheets

U.S. PATENT DOCUMENTS

| | | | | |
|---|---|---|---|---|
| 5,727,687 | A * | 3/1998 | Renner | 206/532 |
| 5,873,483 | A | 2/1999 | Gortz | |
| 5,927,500 | A | 7/1999 | Godfrey et al. | |
| 5,944,191 | A | 8/1999 | Ray et al. | |
| 6,161,699 | A | 12/2000 | Gartland | |
| 6,244,442 | B1 * | 6/2001 | Inoue et al. | 206/531 |
| 6,544,629 | B1 * | 4/2003 | Bailey | 428/192 |
| 6,830,149 | B2 | 12/2004 | Merboth et al. | |
| 7,165,676 | B2 | 1/2007 | Dalessandro | |

FOREIGN PATENT DOCUMENTS

| | | | |
|---|---|---|---|
| EP | 1 357 050 | A1 | 10/2003 |
| GB | 3002309 | | 4/2002 |
| GB | 3002310 | | 4/2002 |
| GB | 3002243 | | 3/2003 |
| WO | WO 99/25307 | | 5/1999 |
| WO | WO 2005/023670 | A1 | 3/2005 |
| WO | WO/ 2005/051284 | A2 | 6/2005 |

* cited by examiner

SEAL

This application is a continuation of prior PCT Application PCT/GB2005/003058, filed 4 Aug. 2005.

The invention relates to a seal for a pill dispenser for dispensing pills, tablets or capsules, or combinations thereof.

It is known in hospitals and other establishments such as, for example, nursing homes, where the dosage of medicines for individual patients is made up from a central dispensary, to use pill dispensers to store the medicines for individual patients and provide a practical aid to indicate when the medicines should be taken.

Known pill dispensers often include a tray 10, as shown in FIG. 1, having a body 12 including a plurality of recesses 14 formed in a surface 16 of the body 12. Each recess 14 has an open mouth 18 bounded by a surrounding portion of the body surface 16 and the required medicines, in the form of one or more pills, tablets and/or capsules, are placed in the recesses 14.

The recesses 14 are then closed, by means of a film adhered to the body surface 16 of the tray 10 and/or by placing the tray 10 in a dispensing container.

Two such dispensing containers are disclosed in European patents nos. 0 454 705 and 0 541 643 and include boxes having hinged lids. In each of these containers, the lid defines a plurality of windows aligned with the recesses in the tray, allowing the contents of the tray to be dispensed selectively through the windows.

The film optionally adhered to the body surface of the tray is often perforated to define tear lines. Whilst the use of tear lines assists removal of the film in a selective manner, it often requires a relatively large force to break the frangible connections remaining between the removable portion and the remainder of the film. This can cause problems for weak and frail patients using the dispenser. Also, if the force required to break the frangible connections is greater than the adhesive bond between the film and the tray, it can result in the entire film becoming detached from the tray and may result in the contents of the tray falling out.

However, whilst these arrangements prevent the contents of the tray falling out, it is becoming increasingly desirable to ensure that the contents are also sealed against contamination. Consequently, it is important to seal each recess of the tray to prevent the ingress of air and moisture. This of course cannot be achieved using a perforated film and/or a dispensing container.

One solution is to close each recess with an imperforate film.

In this type of arrangement, it is necessary to puncture the imperforate cover using a tool such as, for example, a stylus, in order to obtain access to pills, tablets and/or capsules contained in each recess. This can lead to problems since a certain degree of strength and dexterity is required to puncture the cover accurately, and it also requires the provision of a tool, which may, over time, become lost.

A general aim of the invention therefore is to provide a seal for a pill dispenser, which seals individual recesses in the pill dispenser from contaminants whilst ensuring that the recesses are easily accessible.

According to an aspect of the invention there is provided a seal for a pill dispenser having a body including a plurality of recesses formed in a surface of the body, each recess having an open mouth bounded by a surrounding portion of the body surface, the seal comprising a cover film defining a plurality of apertures to provide access to the open mouths of the recesses, each aperture being cut in the cover film so as to be smaller than the open mouth of the corresponding recess and being closed by a liner cut from a liner film, the liner being larger then the aperture and being adhered to the cover film around the entire periphery of the aperture, the seal in use being adhered to the body surface of the pill dispenser so that the liners are located between the cover film and the open mouths of the corresponding recesses and each liner is removable by pushing the liner into the corresponding recess to release the liner from the cover film.

The use of a liner adhered to, what in use will be, the underside of the cover film, about the entire periphery of a corresponding aperture, provides a means of sealing each recess when the seal is adhered to the body surface of the pill dispenser.

The use of a liner adhered to the cover film, to close each recess, also makes access to each recess easier in the sense that a user does not require the strength and dexterity, or tool, needed to puncture an imperforate cover accurately. In addition, the user is not required to tear either the cover film or the liner film, which would require more strength and dexterity than required to push the liner into the recess in order to release the adhesive bond between the liner and the cover film.

The use of a liner also renders the seal tamper evident since it is impossible to remove the liner and then replace it after tampering.

According to another aspect of the invention there is provided a method of manufacturing a seal for a pill dispenser having a body including a plurality of recesses formed in a surface of the body, each recess having an open mouth bounded by a surrounding portion of the body surface, the method comprising the step of providing a cover film adhered in face to face contact with a liner film, the cover film defining a plurality of apertures and the liner film being cut to form a plurality of liners corresponding in position to the apertures, each aperture being smaller than the corresponding liner such that the liner is adhered to the cover film about the entire periphery of the aperture.

Embodiments of the invention will now be described, by way of non-limiting examples, with reference to the accompanying drawings in which.

Figure 2:
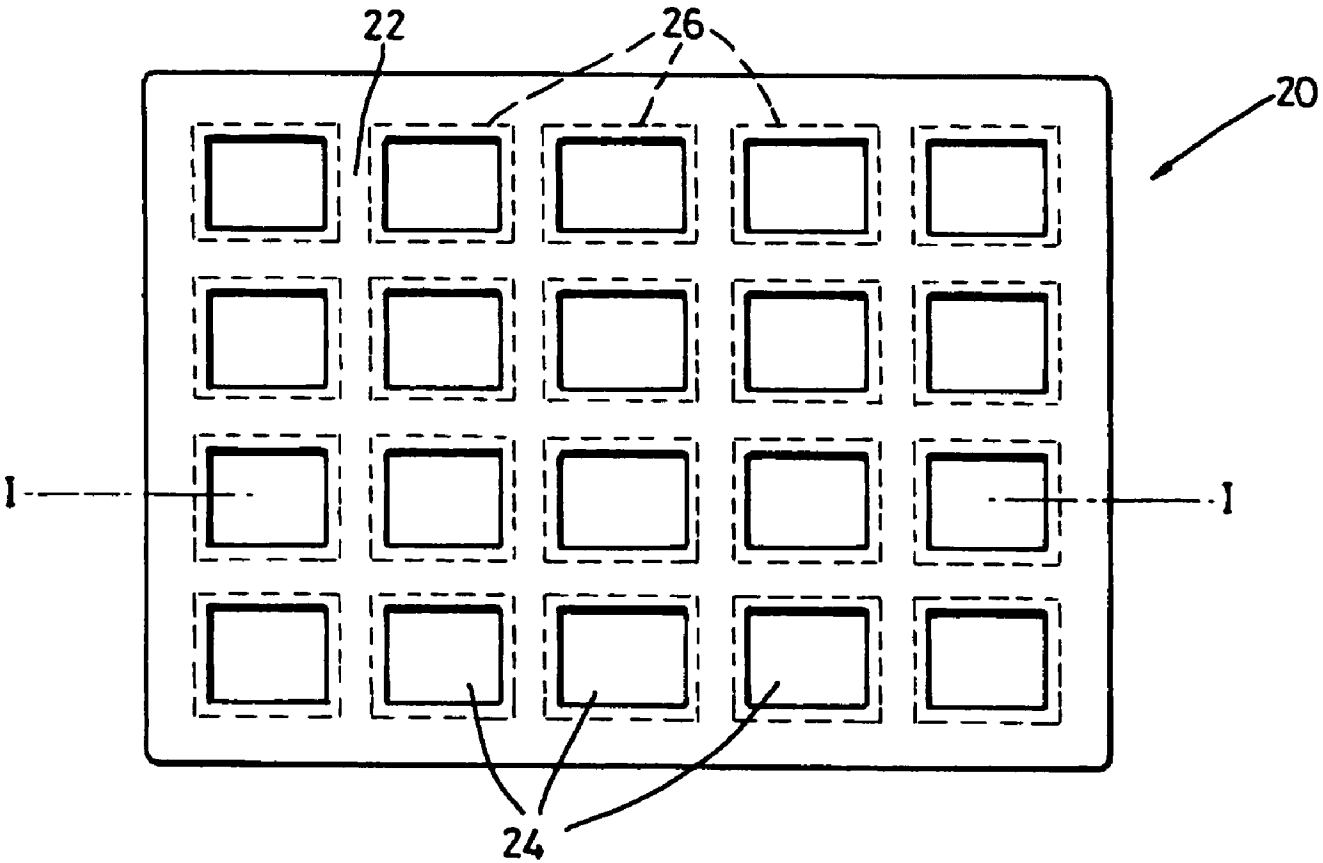
FIG. 2 shows a schematic illustration of a seal for a pill dispenser according to an embodiment of the invention.
Figure 3:
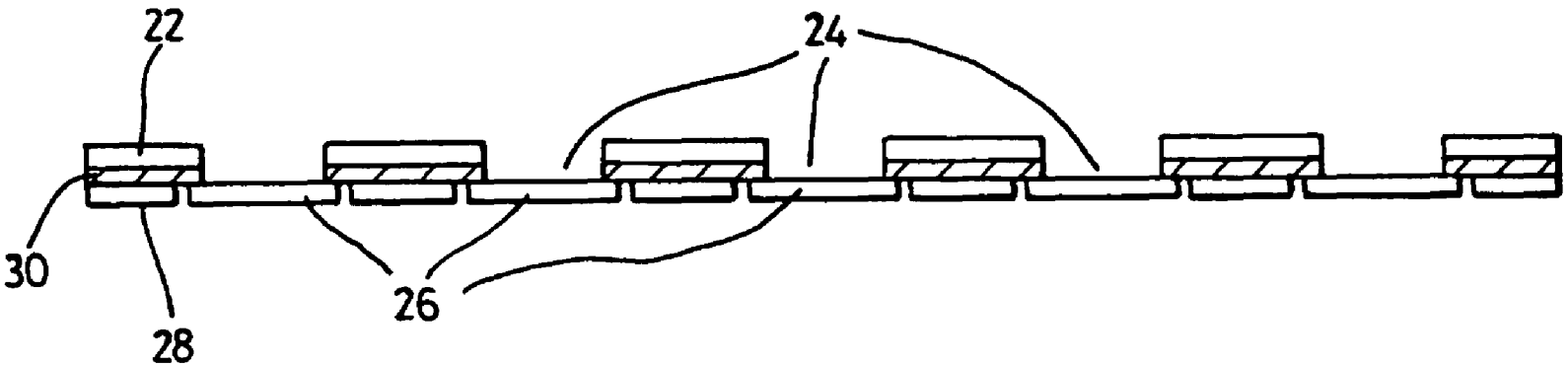
FIG. 3 shows a cross-sectional view along the line I-I of FIG. 2.

A seal 20 for a pill dispenser according to an embodiment of the invention is shown in FIGS. 2 and 3.

The seal 20 includes a cover film 22 defining a plurality of apertures 24 cut in the cover film 22. Each of the apertures 24 is closed by a liner 26 (shown in dotted lines in FIG. 2 for illustrative purposes only) cut from a liner film 28, the liner 26 being larger than the aperture 24 and adhered to the cover film 22 around the entire periphery of the aperture 24.

Figure 1:
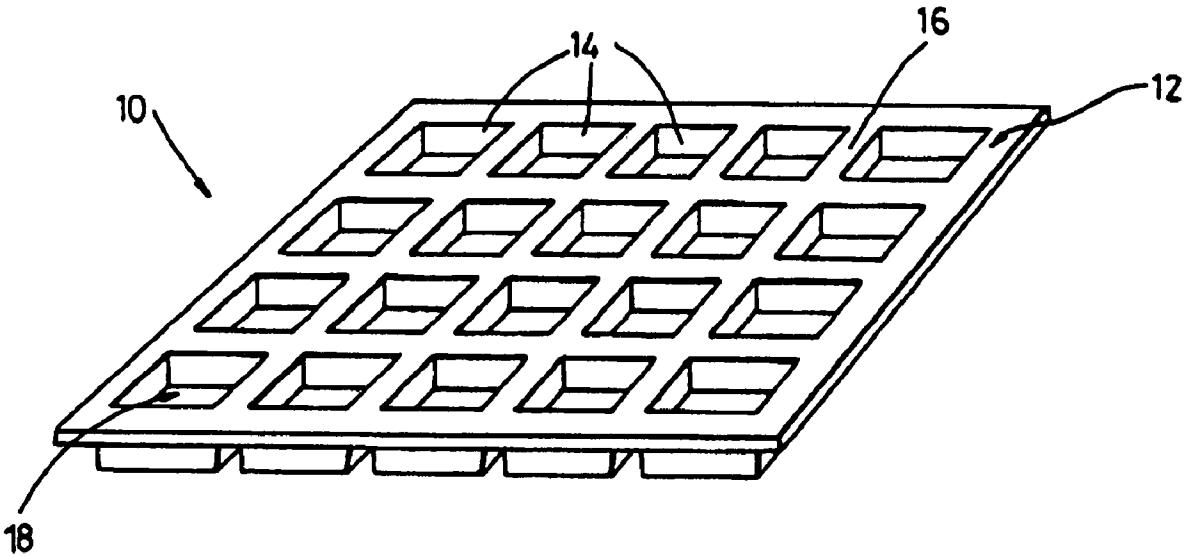
Fig. 1 PRIOR ART
FIG. 1 shows a schematic illustration of a pill dispenser.

The seal 20 in use is adhered to the body surface 16 of the tray 10 shown in FIG. 1. Consequently, the apertures 24 in the cover film 22 are arranged to correspond to the layout of the recesses 14 in the tray 10, and each aperture 24 is cut in the cover film 22 so as to be smaller than the open mouth 18 of the corresponding recess 14.

Similarly, each liner 26 is cut from the liner film 28 so as to be larger than the corresponding aperture 24, but not larger than the open mouth 18 of the corresponding recess 14 in the tray 10.

Preferably, each liner 26 corresponds in shape and size to the open mouth 18 of the corresponding recess 14 in the tray 10.

The cover film 22 may be formed from a sheet of clear material having a thickness in the range of 20-100 microns, and is preferably formed from polypropylene. In such embodiments, the polypropylene preferably has a thickness of 60 microns.

The liner film 28 may be formed from a sheet of clear material having a thickness in the range of 20-100 microns, and is preferably formed from polypropylene. In such embodiments, the polypropylene preferably has a thickness of 50 microns.

The liner film 28 is preferably adhered in face to face contact with the cover film 22 such that the liner film 28 is peelable from the cover film, leaving the liners 26 adhered to the cover film 22, to expose a layer of adhesive 30 on the cover film 22 to adhere the cover film 22 to the body surface 16 of the tray 10.

The cover film 22 is preferably printed to include markings to identify, in use, individual recesses 14 of the tray 10 in terms of time intervals in a dispensing programme for one or more medicines. For example, the markings may identify individual recesses 14 in terms of days and specific time intervals throughout each day.

In use, the seal 20 is adhered to the body surface 16 of the tray 10, preferably by removing the liner film 28 to reveal a layer of adhesive 30 on the cover film 22.

The seal 20 is adhered to the body surface 16 such that the apertures 24 are aligned with the corresponding recesses 14 in the tray 10, and the liners 26 are located between the cover film 22 and the open mouths 18 of the recesses 14.

The adhesive 30 is preferably a food grade permanent emulsion adhesive.

The cover film 22 preferably includes security cuts (not shown), which prevent the seal 20 being removed from the body surface 16 of the tray 10 in one piece. This helps to ensure that the seal 20 cannot be removed and replaced easily, thereby helping to provide a tamper-evident seal and rendering the tray 10 non-reusable. It is important to render the tray 10 non-reusable for hygiene purposes, and to prevent possible cross-contamination of medicines.

Once the seal 20 is adhered to the body surface 16 of the tray 10, medicines contained in each of the recesses 14 are sealed by virtue of the adhesive seal between the corresponding liner 26 and the cover film 22 about the entire periphery of the corresponding aperture 24, and by virtue of the adhesive seal between the cover film 22 and the body surface 16 bounding the recess 14.

The use of liners 26 which correspond in shape and size to the open mouths 18 of the recesses 14 ensures that medicines contained in the recesses 14 do not come into contact with the adhesive 30.

Access to the medicines contained in a recess 14 is obtained by pressing the corresponding liner 26 into the recess 14. This pressure releases the adhesive bond between the liner 26 and the cover film 22, allowing the liner 26 to be removed using a finger and thumb "pinch" technique.

This arrangement for opening a recess 14 requires less strength and dexterity than an arrangement where the cover film is perforated to define tear lines requiring the user to pull a section of the cover away from the tray. This is of course important in instances where the user is weak and frail.

Figure 4:
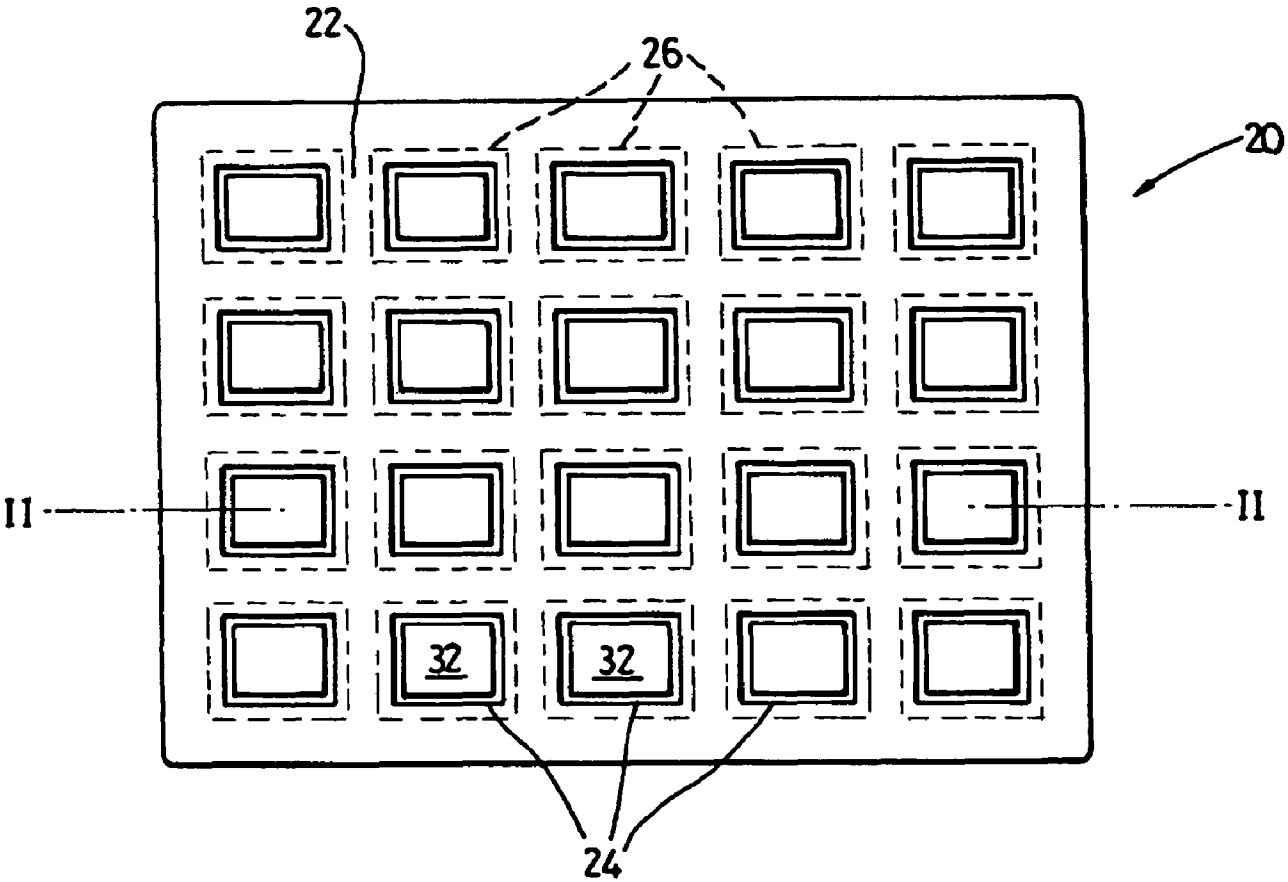
FIG. 4 shows a schematic illustration of a seal for a pill dispenser according to another embodiment of the invention.
Figure 5:
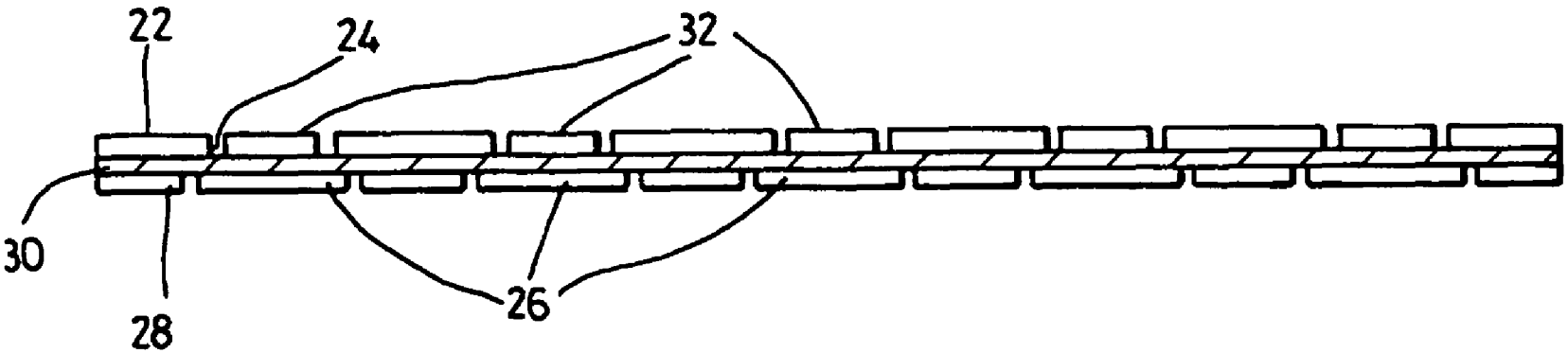
FIG. 5 shows a cross-sectional view along the line II-II of FIG. 4.

In other embodiments, such as that shown in FIGS. 4 and 5, the seal 20 may further include a cover 32 located in each aperture 24 to close the apertures 24, each cover 32 being cut from the cover film 22 such that it is the same shape and size as the corresponding aperture 24.

In such an embodiment, each cover 32 is retained in position within the corresponding aperture 24 by the corresponding liner 26 (shown in dotted lines in FIG. 4 for illustrative purposes only) adhered to the cover film 22 around the entire periphery of the corresponding aperture 24, and is preferably adhered in face to face contact with the corresponding liner 26.

Once the seal 20 is adhered to the body surface 16 of the tray 10, the provision of a cover 32 effectively doubles the thickness of material over the open mouths 18 of the recesses 14, further ensuring that the closure provided by the seal 20 is impermeable to potential contaminants. It also makes it harder for someone to remove and replace the liner 26 after tampering.

Access to the medicines contained in a recess 14 is obtained by pressing the corresponding cover 32 and liner 26 into the recess 14. As explained earlier, this pressure releases the adhesive bond between the liner 26 and the cover film 22, allowing the cover 32 and the liner 26 to be removed using a finger and thumb "pinch" technique.

In either of the two embodiments described with reference to FIGS. 2-5, each of the covers 32 and/or the liners 26 may include a marking printed on their surface. This is of particular assistance to people with poor sight as it helps them to see more easily which recesses have been opened.

A method of manufacturing the seal 20 shown in FIGS. 4 and 5 will now be described.

A sheet of liner film 28 is adhered in face-to-face contact with a sheet of cover film 22 using a layer of adhesive 30. Any markings are then printed on the cover film 22 and/or the liner film 28 as required.

The cover film 22 may be formed from a sheet of clear material having a thickness in the range of 20-100 microns, and is preferably formed from polypropylene. In such embodiments, the polypropylene preferably has a thickness of 60 microns.

The liner film 28 may be formed from a sheet of clear material having a thickness in the range of 20-100 microns, and is preferably formed from polypropylene. In such embodiments, the polypropylene preferably has a thickness of 50 microns.

The liner film 28 is kiss cut, preferably using a rotary die cutter, a flatbed cutter or a laser cutter, to cut the liners 26 from the liner film 28. The cover film 22 is then kiss cut, preferably using a rotary die cutter, a flatbed cutter or a laser cutter, to cut a corresponding number of covers 32 from the cover film 22, each cover 32 being aligned with, and smaller than, a corresponding liner 26.

The kiss cutting process does not break the adhesive bond between the cover film 22 and the liner film 26. Consequently, each of the covers 32 remains adhered in face-to-face contact with the corresponding liner 26, and each of the liners 26 remains adhered to the cover film 22 about the entire periphery of the corresponding cover 32.

In order to adhere the seal 20 to the body surface 16 of a tray 10, the liner film 28 is peeled from the cover film 22, leaving the liners 26 adhered to the cover film 22, to expose adhesive on the cover film 22. The cover film 22 may then be positioned on the body surface 16 of the tray 10 and adhered in position by applying pressure.

Figure 6:
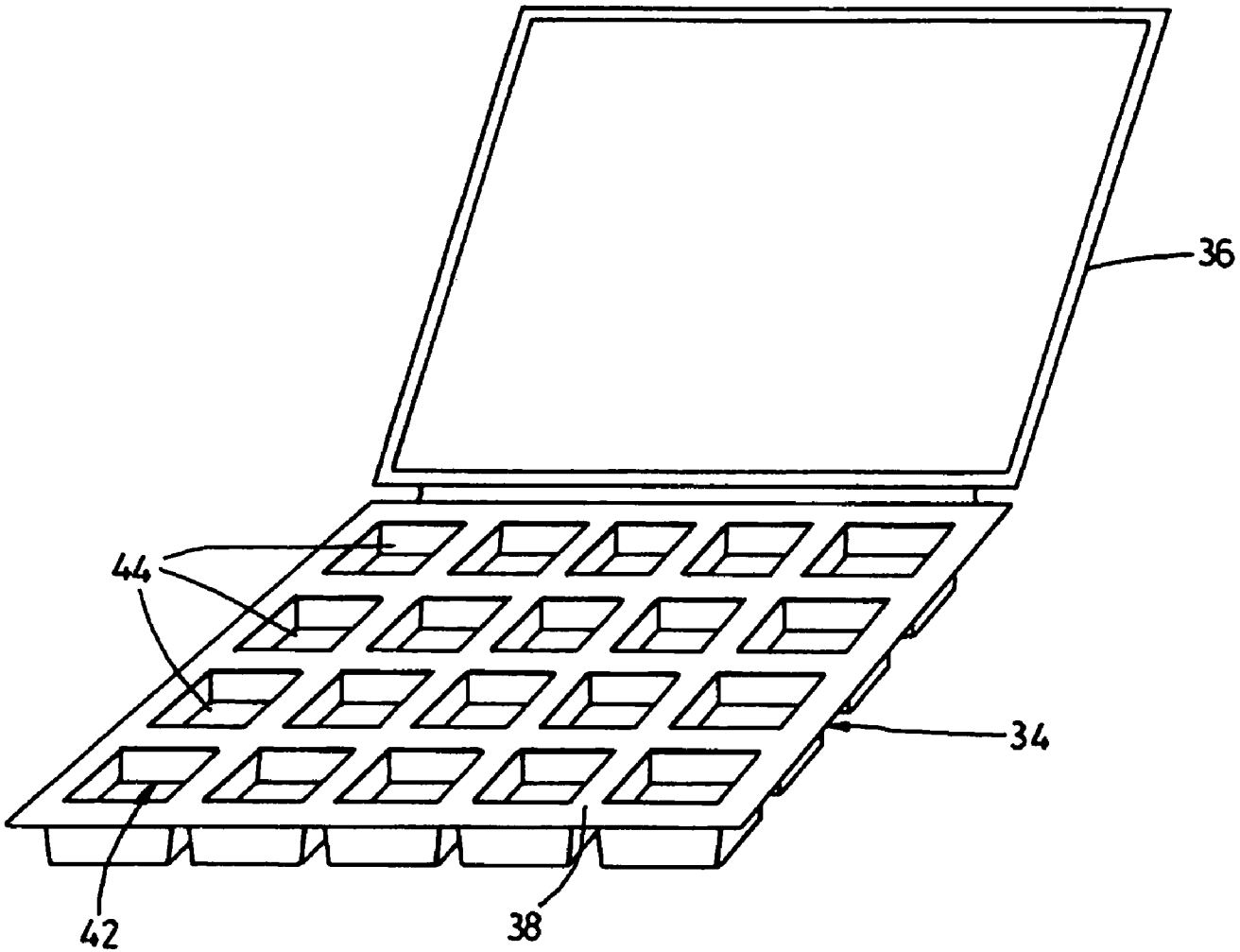
FIG. 6 shows a schematic illustration of another pill dispenser.

Use of the seal 20 has been described with reference to a pill dispenser in the form of a tray 10 which may be used alone or in combination with a dispensing container such as those disclosed in European patents nos. 0 454 705 and 0 541 643. However, it is also envisaged that the seal 20 could be used with a pill dispenser in the form of a tray 34 having a lid 36 hingedly connected to the body 38 of the tray 34 for movement between a first position whereat the lid 36 overlies the mouths 42 of all of the recesses 44 to prevent access thereto, and a second position whereat the lid 36 is spaced from the mouths 42 of the recesses 44 to permit access thereto, as shown in FIG. 6.

In this arrangement, the body 38 and lid 36 may be formed integrally from a single sheet of plastics material, wherein the sheet of plastics material may be vacuum formed in order to define the shapes of the body 38 and lid 36, and to define the hinge connection therebetween.

The sheet of plastics material may be formed from polyvinylchloride or amorphous polyethylene terephthalate, and may have a thickness in the range of 275-600 microns.

The invention claimed is:

1. A method of manufacturing a seal for a pill dispenser having a body including a plurality of recesses formed in a surface of the body, each recess having an open mouth bounded by a surrounding portion of the body surface, the method comprising the step of providing a cover film adhered in face to face contact with a liner film, the cover film defining a plurality of apertures and a cover located in each aperture to close the aperture, and the liner film defining a plurality of liners corresponding in position to the apertures, each aperture being smaller than the corresponding liner such that the liner is adhered to the cover film about the entire periphery of the aperture, and each cover being retained in position by the corresponding liner, wherein the liner film is peelable from the cover film such that when the liner film is peeled away the plurality of liners are left adhered to the cover film and a layer of adhesive is exposed on the cover film.

2. A method of manufacturing a seal according to claim 1 comprising the steps of: (a) adhering a liner film in face to face contact with a cover film; (b) cutting the liner film to cut a plurality of liners in the film; and (c) cutting the cover film to cut a plurality of covers in the cover film, each cover being aligned with, and smaller than, a corresponding liner such that the liner is adhered to the cover film around the entire periphery of the cover.

3. A method of manufacturing a seal according to claim 2 wherein the liners are rotary die cut from the liner film and the covers are rotary die cut from the cover film.

4. A method of manufacturing a seal according to claim 2 wherein the liner film is adhered in face to face contact with the cover film using a food grade permanent emulsion adhesive such that the liner film is peelable from the cover film, leaving the liners adhered to the cover film, to expose the adhesive to enable the cover film to be adhered to the body surface of the pill dispenser.

5. A method of manufacturing a seal for a pill dispenser having a body including a plurality of recesses formed in a surface of the body, each recess having an open mouth bounded by a surrounding portion of the body surface, the method comprising the step of providing a cover film adhered in face to face contact with a liner film, the cover film defining a plurality of removable covers and the liner film defining a plurality of liners corresponding in position to the removable covers, each removable cover being smaller that the corresponding liner such that the liner is adhered to the cover film about the entire periphery of the removable cover, wherein the liner film is peelable from the cover film such that when the liner film is peeled away the plurality of liners are left adhered to the cover film and a layer of adhesive is exposed on the cover film.

6. A method of preparing a seal for use with a pill dispenser having a body including a plurality of recesses formed in a surface of the body, each recess having an open mouth bounded by a surrounding portion of the body surface, the method comprising the steps of:

adhering a cover film in face to face contact with a liner film by a layer of adhesive;

forming a plurality of apertures and a plurality of covers in the cover film, the plurality of apertures defined by cut lines and the plurality of covers comprising a cover located in each aperture to close the aperture; and forming a plurality of liners and a surrounding liner film portion from in the liner film, the plurality of liners and the surrounding liner film portion being defined by cut lines, the surrounding liner film portion surrounding each of the liners, wherein the liners correspond in position to the apertures, each aperture is smaller than the corresponding liner such that the liner is adhered to the cover film about the entire periphery of the aperture, and each cover is retained in position by the corresponding liner; and removing the surrounding liner film portion from the layer of adhesive.

7. A method of preparing a seal for use with a pill dispenser having a body including a plurality of recesses formed in a surface of the body, each recess having an open mouth bounded by a surrounding portion of the body surface, the method comprising the steps of:

adhering a cover film in face to face contact with a liner film by a layer of adhesive;

forming a plurality of removable covers in the cover film; and forming a plurality of liners in the liner film and a surrounding liner film portion that surrounds the plurality of liners, wherein the liners correspond in position to the removable portions, and each removable portion is smaller than the corresponding liner such that the liner is adhered to the cover film about the entire periphery of the removable portion; and removing the surrounding liner film from the layer of adhesive.

* * * * *